US010859354B1

(12) United States Patent
Huang

(10) Patent No.: US 10,859,354 B1
(45) Date of Patent: Dec. 8, 2020

(54) ARROW INSERT WITH THREADED STEM FOR RETAINING AN ARROW TIP

(71) Applicant: Dorge O. Huang, Henry, IL (US)

(72) Inventor: Dorge O. Huang, Henry, IL (US)

( * ) Notice: Subject to any disclaimer, the term of this patent is extended or adjusted under 35 U.S.C. 154(b) by 0 days.

(21) Appl. No.: 16/797,627

(22) Filed: Feb. 21, 2020

(51) Int. Cl.
*F42B 6/08* (2006.01)

(52) U.S. Cl.
CPC ..... *F42B 6/08* (2013.01)

(58) Field of Classification Search
CPC ..... F42B 6/04; F42B 6/08
USPC ..... 473/578, 582
See application file for complete search history.

(56) References Cited

U.S. PATENT DOCUMENTS 4,050,696 A * 9/1977 Troncoso, Jr. ..... F42B 6/04 473/585
4,141,554 A * 2/1979 Sherwin ..... F42B 6/06 403/268
4,210,330 A * 7/1980 Kosbab ..... F42B 6/08 473/584
4,381,866 A * 5/1983 Simo ..... F42B 6/08 30/337
4,410,184 A * 10/1983 Anderson ..... F42B 6/08 473/584
4,504,063 A * 3/1985 LeBus ..... F42B 6/08 473/584
4,874,180 A * 10/1989 Fingerson ..... F42B 6/04 473/578
5,094,463 A * 3/1992 Dryden ..... F42B 12/385 342/386
5,269,534 A * 12/1993 Saunders ..... F42B 6/08 403/343
5,417,440 A * 5/1995 Barrie ..... F42B 6/08 473/584
5,516,117 A * 5/1996 Rangel ..... F42B 6/04 403/288
5,902,199 A * 5/1999 Adams, Jr. ..... F42B 6/04 473/578
6,027,421 A * 2/2000 Adams, Jr. ..... F42B 6/08 473/578
6,739,992 B2 * 5/2004 Kummerle ..... F42B 6/08 473/582
7,004,859 B2 * 2/2006 Palomaki ..... F42B 6/04 473/578
7,077,770 B2 * 7/2006 Palomaki ..... F42B 6/04 473/578
7,651,421 B2 * 1/2010 Smith ..... F42B 6/04 473/582

(Continued)

*Primary Examiner* — Alexander R Niconovich
(74) *Attorney, Agent, or Firm* — Donald J. Ersler

(57) ABSTRACT

An arrow insert with threaded stem for retaining an arrow tip preferably includes an arrow tip and an arrow insert. The arrow tip includes tip portion formed on one end and a threaded tap formed in an opposite end thereof. An O-ring counter bore is formed in the opposite end. The arrow insert preferably includes a barbed shank, an arrow shaft contact portion, an end flange, an arrow tip locator, at least one O-ring groove and a threaded stem. The barbed shank extends from one end of the arrow shaft contact portion. The end flange extends from an opposing end of the arrow shaft contact portion. The arrow tip locator extends from the end flange. The threaded stem extends from the arrow tip locator. The at least one O-ring groove is formed in the arrow tip locator.

18 Claims, 2 Drawing Sheets

(56) References Cited

U.S. PATENT DOCUMENTS

| | | | | |
|---|---|---|---|---|
| 7,811,186 | B2 * | 10/2010 | Palomaki | F42B 6/08 473/578 |
| 8,016,703 | B1 * | 9/2011 | Kronengold | F42B 6/08 473/582 |
| 8,057,330 | B2 * | 11/2011 | Blosser | F42B 6/04 473/582 |
| 8,337,341 | B1 * | 12/2012 | Huang | F42B 6/08 473/582 |
| 8,403,777 | B1 * | 3/2013 | Huang | F42B 6/04 473/582 |
| 8,480,520 | B2 * | 7/2013 | Webber | F42B 6/08 473/582 |
| 9,068,804 | B2 * | 6/2015 | McPherson | F42B 6/08 |
| 9,366,510 | B1 * | 6/2016 | Zobell | F42B 6/04 |
| 9,410,773 | B2 * | 8/2016 | Greenwood | F42B 6/04 |
| 9,441,927 | B1 * | 9/2016 | Huang | F42B 6/08 |
| 9,915,510 | B1 * | 3/2018 | Huang | F42B 6/08 |
| 2007/0123378 | A1 * | 5/2007 | Polando | F42B 6/08 473/583 |
| 2012/0028741 | A1 * | 2/2012 | Palomaki | F42B 6/08 473/583 |

* cited by examiner

ARROW INSERT WITH THREADED STEM FOR RETAINING AN ARROW TIP

BACKGROUND OF THE INVENTION

1. Field of the Invention

The present invention relates generally to archery and more specifically to an arrow insert with threaded stem for retaining an arrow tip, which includes a pair of O-rings for preventing the arrow tip from loosening from the insert.

2. Discussion of the Prior Art

Arrow tips are commonly retained on threaded stems of inserts. However, the arrow tips have to be frequently replaced, which does not allow a locking compound to be applied to the threads. U.S. Pat. No. 8,337,341 to Huang discloses an arrow tip. U.S. Pat. No. 9,915,510 to Huang discloses a variable weighted arrow tip.

Accordingly, there is a clearly felt need in the art for an arrow insert with a threaded stem for retaining an arrow tip, which includes a pair of O-rings for preventing the arrow tip from loosening from an threaded stem; increasing consistency in shooting the arrow; and maintaining concentricity between the arrow shaft and the arrow tip.

SUMMARY OF THE INVENTION

The present invention provides an arrow insert with threaded stem for retaining an arrow tip, which includes a pair of O-rings for preventing the arrow tip from loosening from the insert. The arrow insert with threaded stem for retaining an arrow tip (arrow tip insert) preferably includes an arrow tip and an arrow insert. The arrow tip includes a tip portion formed on one end and a threaded tap formed in an opposite end of the arrow tip. An O-ring counter bore is formed in the opposite end. The arrow insert preferably includes a barbed shank, an arrow shaft contact portion, an end flange, an arrow tip locator, at least one O-ring groove and a threaded stem. The barbed shank extends from one end of the arrow shaft contact portion. One end of the end flange extends from an opposing end of the arrow shaft contact portion. One end of the arrow tip locator extends from an opposing end of the end flange. The threaded stem extends from an opposing end of the arrow tip locator. The at least one O-ring groove is formed in and around the arrow tip locator.

The arrow tip insert is preferably assembled in the following manner. At least one O-ring is inserted into the at least one O-ring groove. A bonding agent is applied to the barbed shank. The barbed shank is then inserted into an arrow shaft. The threaded stem is then threaded into the threaded tap in the arrow tip. The at least one O-ring will prevent the arrow tip from unthreading from the threaded stem.

Accordingly, it is an object of the present invention to provide an arrow insert with a threaded stem for retaining an arrow tip, which preferably includes a pair of O-rings for preventing the arrow tip from loosening from the threaded stem; increasing consistency in shooting an arrow; and maintaining concentricity between the arrow shaft and the arrow tip.

These and additional objects, advantages, features and benefits of the present invention will become apparent from the following specification.

DETAILED DESCRIPTION OF THE PREFERRED EMBODIMENTS

Figure 1:
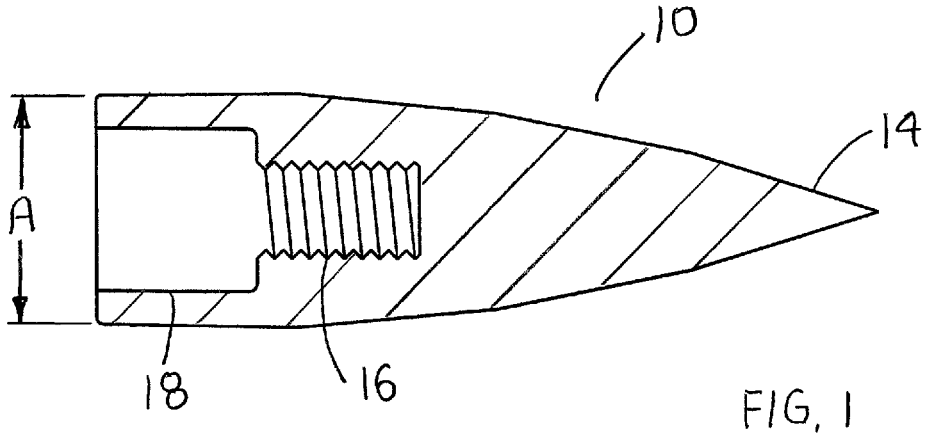
FIG. 1 is a side cross sectional view of an arrow tip of an arrow tip insert in accordance with the present invention.
Figure 2:
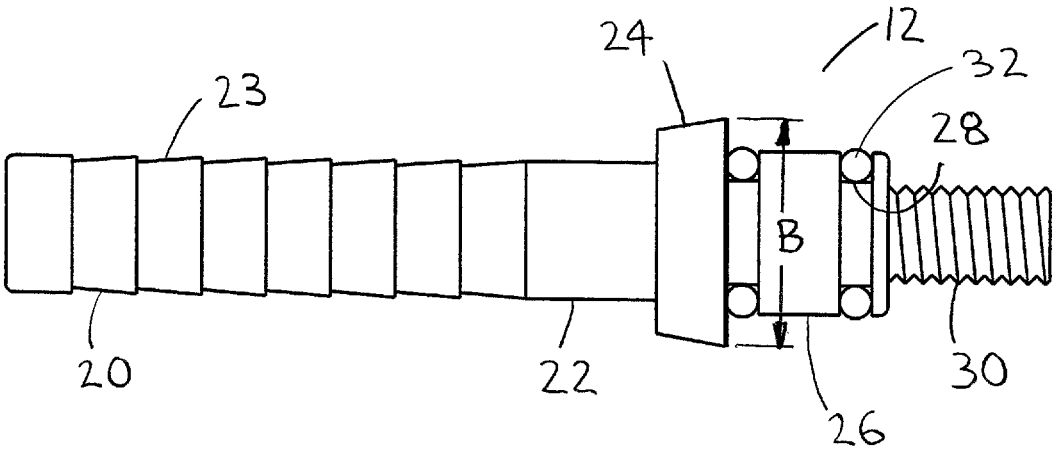
FIG. 2 is a side view of an arrow insert of an arrow tip insert in accordance with the present invention.
Figure 3:
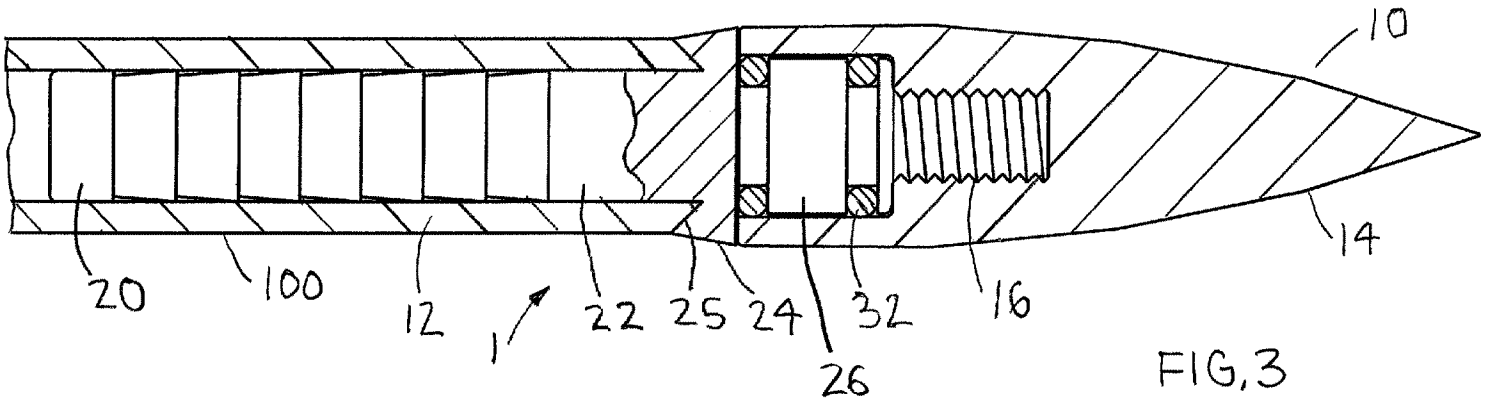
FIG. 3 is a side cross sectional view of an arrow insert threaded into an arrow tip and the arrow insert retained in an arrow shaft of an arrow tip insert in accordance with the present invention.
Figure 4:
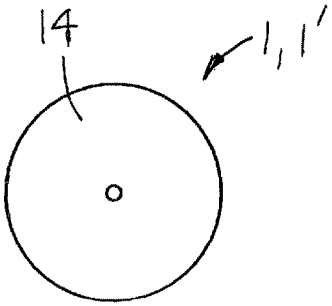
FIG. 4 is a front end view of an arrow insert threaded into an arrow tip and the arrow inserted retained in an arrow shaft of an arrow tip insert in accordance with the present invention.

With reference now to the drawings, and particularly to FIG. 3, there is shown an arrow tip insert 1 retained in an archery arrow shaft 100. With reference to FIGS. 1, 2 and 4, the arrow tip insert 1 preferably includes an arrow tip 10 and an arrow insert 12. The arrow tip 10 includes a tip portion 14 formed on one end and a threaded tap 16 is formed in an opposite end of the arrow tip 10. An O-ring counter bore 18 is formed in the opposite end. The arrow insert 12 preferably includes a barbed shank 20, an arrow shaft contact portion 22, an end flange 24, an arrow tip locator 26, at least one O-ring groove 28 and a threaded stem 30. With reference to FIG. 3, the end flange 24 preferably includes an angular undercut 25, which allows a 45 degree chamfer to be formed on an end of an arrow shaft 100. The 45 degree chamfer resists mushrooming of an of the arrow shaft 100. An outer perimeter of end flange 24 is preferably slopped to match a diameter of the arrow tip 10 and the arrow shaft 100. The barbed shank 20 extends from one end of the arrow shaft contact portion 22. The arrow shaft contact portion 22 locates the arrow insert in an inner perimeter 102 of the arrow shaft 100. The barbed shaft 20 preferably includes a plurality of barb projections 23. One end of the end flange 24 extends from an opposing end of the arrow shaft contact portion 22. One end of the arrow tip locator 26 extends from an opposing end of the end flange 24. The threaded stem 30 extends from an opposing end of the arrow tip locator 26. The at least one O-ring groove 28 is formed in and around the arrow shaft contact portion 26.

The arrow tip insert 1 is preferably assembled in the following manner. At least one O-ring 32 is inserted into the at least one O-ring groove 28. A bonding agent is applied to the barbed shank 20. The barbed shank 20 is then inserted into an arrow shaft 100. The threaded stem 30 is then threaded into the threaded tap 16 in the arrow tip 10. The at least one O-ring 32 will prevent the arrow tip 10 from unthreading from the threaded stem 30; increase consistency in shooting an arrow; and maintaining concentricity between the arrow shaft 100 and the arrow tip 10. A largest perimeter "A" of the arrow tip 10 is preferably slightly larger than a largest perimeter "B" of the end flange 24 to allow the arrow tip insert 1 to be easily removed from a target.

Figure 2A:
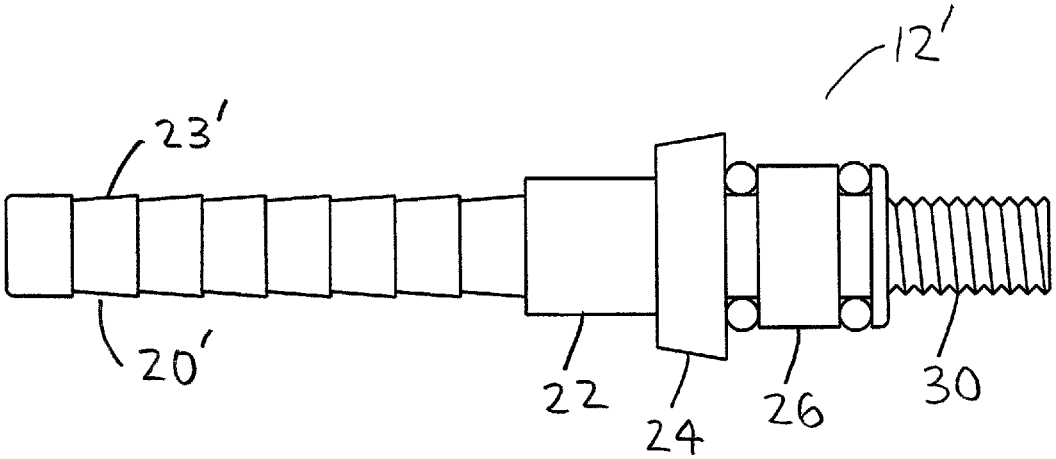
FIG. 2*a* is a side view of an arrow insert for a double wall arrow shaft of an arrow tip insert in accordance with the present invention.
Figure 3A:
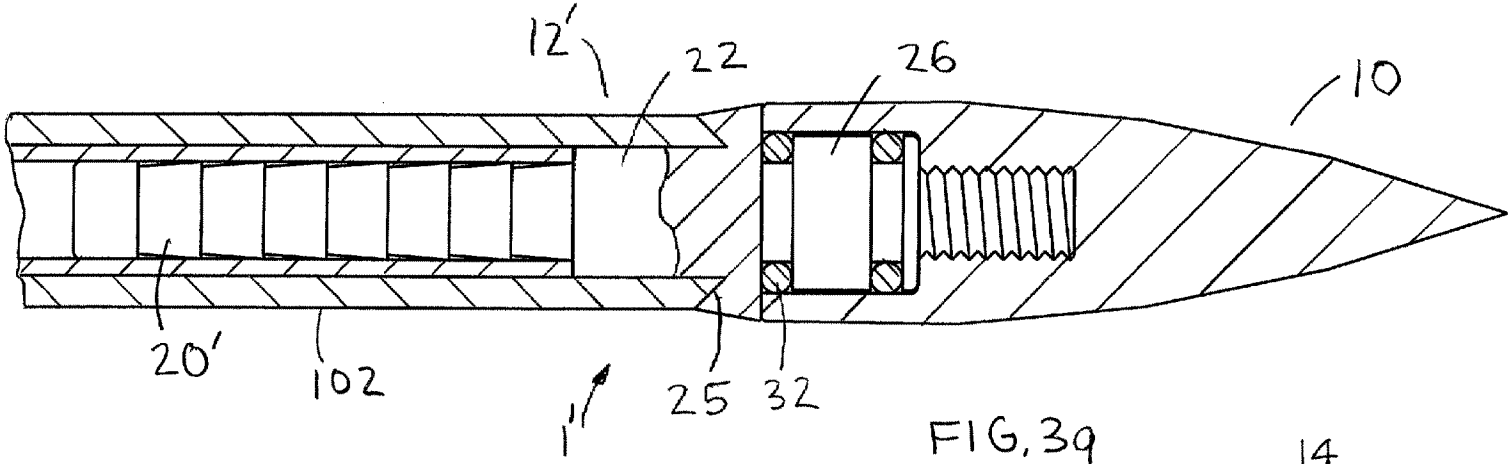
FIG. 3*a* is a side cross sectional view of an arrow insert for a double wall arrow shaft threaded into an arrow tip and the arrow insert retained in the double wall arrow shaft of an arrow tip insert in accordance with the present invention.

With reference to FIGS. 2*a* and 3*a*, an arrow insert 12' includes a barbed shank 20' instead of the barbed shank 20. The barbed shank 20' has a diameter, which is sized to receive an inner diameter of a double walled arrow shaft 102. The barbed shank 20' includes a plurality of barb projections 23'.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An arrow tip having inner threads for threadable engagement with an arrow insert having an arrow shank, an end flange, an arrow tip locator and an outer threaded stem, the arrow shank extends from one end of the end flange, one end of the arrow tip locator extends from an opposing end of the end flange, the outer threaded stem extends from an opposing end of the arrow tip locator, the arrow shank is sized to be inserted into an inner perimeter of an arrow shaft, comprising:

said arrow tip includes a one piece pointed tip, a counterbore and inner threads, said counterbore is formed in an end opposite said pointed tip, said inner threads are formed at a bottom of said counterbore, wherein said counterbore is sized to receive the arrow tip locator, the end flange is in direct contact with said end opposite of said pointed tip, said inner threads are sized to be threadably engaged with the outer threaded stem.

2. The arrow tip of claim 1 wherein:

a largest perimeter of the arrow tip is greater than a largest perimeter of the end flange.

3. The arrow tip of claim 1 wherein:

a bonding substance is applied to the arrow shank to retain the arrow shank in the arrow shaft.

4. The arrow tip of claim 1 wherein:

the arrow shaft includes a double wall.

5. An arrow insert with threaded stem for retaining an arrow tip having a counterbore and inner threads, comprising:

an arrow insert includes an arrow shank, an end flange, an arrow tip locator and an outer threaded stem, said arrow shank extends from one end of said end flange, one end of said arrow tip locator extends from an opposing end of said end flange, said threaded stem extends from an opposing end of said arrow tip locator, an outer perimeter of said end flange is sloped, an outer perimeter of said one end of said end flange is sized to equal an outer perimeter of an arrow shaft, wherein said arrow shank is sized to be received by an inner perimeter of the arrow shaft, said arrow tip locator is sized to be received by the counterbore, said threaded stem is sized to be threadably engaged with the inner threads.

6. The arrow insert with threaded stem for retaining an arrow tip of claim 5 wherein:

an angular undercut is formed in a side wall of said end flange to receive a chamfered end of said arrow shaft.

7. The arrow insert with threaded stem for retaining an arrow tip of claim 5 wherein:

a plurality of barb projections are formed along a length of said arrow shank.

8. The arrow insert with threaded stem for retaining an arrow tip of claim 5 wherein:

a largest perimeter of the arrow tip is greater than a largest perimeter of said end flange.

9. The arrow insert with threaded stem for retaining an arrow tip of claim 5 wherein:

a bonding substance is applied to said arrow shank to retain said arrow shank in the arrow shaft.

10. The arrow insert with threaded stem for retaining an arrow tip of claim 5 wherein:

the arrow shaft includes a double wall.

11. The arrow insert with threaded stem for retaining an arrow tip of claim 5 wherein:

at least one O-ring groove is formed in said arrow tip locator.

12. An arrow insert with threaded stem for retaining an arrow tip having inner threads, comprising:

an arrow insert includes an arrow shank, an end flange and an outer threaded stem, said arrow shank extends from one end of said end flange, said threaded stem extends from an opposing end of said end flange, one end of said end flange is equal to a perimeter of an arrow shaft, an outer perimeter of an opposing end of said end flange is equal to an outer perimeter of the arrow tip adjacent said opposing end, an outer perimeter of said end flange is sloped, wherein said arrow shank is sized to be received by an inner perimeter of an arrow shaft, said threaded stem is sized to be threadably engaged with the inner threads, wherein said arrow insert includes an arrow tip locator, one end of said arrow tip locator extends from the opposing end of said end flange, said threaded stem extends from an opposing end of said arrow tip locator, the arrow tip includes a counterbore, the counterbore is sized to receive said arrow tip locator.

13. The arrow insert with threaded stem for retaining an arrow tip of claim 12 wherein:

an angular undercut is formed in a side wall of said end flange to receive a chamfered end of said arrow shaft.

14. The arrow insert with threaded stem for retaining an arrow tip of claim 12 wherein:

a plurality of barb projections are formed along a length of said arrow shank.

15. The arrow insert with threaded stem for retaining an arrow tip of claim 12 wherein:

a largest perimeter of the arrow tip is greater than a largest perimeter of said end flange.

16. The arrow insert with threaded stem for retaining an arrow tip of claim 12 wherein:

a bonding substance is applied to said arrow shank to retain said arrow shank in the arrow shaft.

17. The arrow insert with threaded stem for retaining an arrow tip of claim 12 wherein:

the arrow shaft includes a double wall.

18. The arrow insert with threaded stem for retaining an arrow tip of claim 12 wherein:

at least one O-ring groove is formed in said arrow tip locator.

* * * * *